United States Patent [19]

De Nora et al.

[11] 4,134,806

[45] Jan. 16, 1979

[54] METAL ANODES WITH REDUCED ANODIC SURFACE AND HIGH CURRENT DENSITY AND THEIR USE IN ELECTROWINNING PROCESSES WITH LOW CATHODIC CURRENT DENSITY

[75] Inventors: Oronzio De Nora; Carlo Traini, both of Milan, Italy

[73] Assignee: Diamond Shamrock Technologies, S.A., Geneva, Switzerland

[21] Appl. No.: 833,661

[22] Filed: Sep. 15, 1977

Related U.S. Application Data

[63] Continuation of Ser. No. 436,727, Jan. 25, 1974, abandoned, and Ser. No. 677,179, Apr. 15, 1976, abandoned.

[30] Foreign Application Priority Data

Jan. 29, 1973 [IT] Italy ..... 19738 A/73

[51] Int. Cl.[2] ..... C25C 1/22; C25C 7/02

[52] U.S. Cl. ..... 204/105 R; 204/105 M; 204/280; 204/284; 204/288; 204/290 F

[58] Field of Search ..... 204/105 R, 105 M, 288, 204/284–285, 280, 290 F

[56] References Cited

U.S. PATENT DOCUMENTS

| | | | |
|---|---|---|---|
| 1,269,128 | 6/1918 | Stuart | 204/284 |
| 1,313,246 | 8/1919 | Antisell | 204/288 |
| 1,449,462 | 3/1923 | Van Arsdale | 204/109 |
| 1,738,515 | 12/1929 | Belke | 204/288 |
| 2,766,198 | 10/1956 | Carosella | 204/288 |
| 3,616,445 | 10/1971 | Bianchi et al. | 204/290 F |
| 3,677,929 | 7/1972 | Young | 204/284 |
| 3,778,307 | 12/1973 | Beer | 204/290 F |

FOREIGN PATENT DOCUMENTS

| | | | |
|---|---|---|---|
| 425317 | 3/1935 | United Kingdom | 204/284 |
| 748630 | 5/1956 | United Kingdom | 204/284 |

OTHER PUBLICATIONS

"The Effect of Certain Variables on the Electrodeposition of Mn" by J. H. Jacobs et al., E.C.S. Preprint 10, 10–16–44, pp. 123–124.

Electroplating Engineering Handbook, 2nd Ed. by A. K. Graham, 1962, pp. 62–63.

Chromium Plating by Morisset et al., 1954, pp. 99–100.

Electroforming by P. Spiro, 2nd Ed., 1971, pp. 23–24.

Principles of Electroplating and Electroforming by W. Blum, 3rd Ed., 1949, pp. 285, 341–342.

Modern Electroplating by F. A. Lowenheim, 2nd Ed., 1963, pp. 28–29.

*Primary Examiner*—R. L. Andrews

*Attorney, Agent, or Firm*—Hammond & Littell

[57] ABSTRACT

Describes an electrochemical process operated at relatively low cathodic current density and high anodic current density, particularly for electrowinning and electrorefining processes using dimensionally stable metal anodes with reduced anodic electrocatalytic surfaces to allow full exploitation of the advantages of insoluble metal anodes, such as lower overvoltages, high current density capability, and purer deposits, together with an economical employment of expensive anode materials. Cathodic/anodic current densityratios down to 1/20 are used without materially decreasing overall process efficiency or product's morphology. Choice of geometric parameters, practical aspects, typical embodiments and examples are disclosed.

33 Claims, 8 Drawing Figures

IN ALL THREE CASES THE DISTANCE BETWEEN PLANE AND CATHODE IS 10 cm.

METAL ANODES WITH REDUCED ANODIC SURFACE AND HIGH CURRENT DENSITY AND THEIR USE IN ELECTROWINNING PROCESSES WITH LOW CATHODIC CURRENT DENSITY

This is a continuation of Ser. No. 436,727, filed Jan. 25, 1974 and of Ser. No. 677,179 filed Apr. 15, 1976, both now abandoned.

This invention relates to a process for electrowinning of metals from acid solutions containing the metal to be recovered by the use of dimensionally stable non-corrosive valve metal anodes made from titanium, zirconium, hafnium, vanadium, niobium, tantalum, molybdenum and tungsten, or alloys thereof, provided with a non-passivating exterior surface or coating having electrocatalytic properties with reference to the release of oxygen and chlorine and in which the surface area of the anode facing the cathode is from 1.5 to 20 times less than the surface area of the cathode, whereby the anodic current density can be from 1.5 to 20 times higher than the cathode current without exceeding the cathode current density limit. The anodes preferably have an open framework structure which permits free circulation of the electrolyte through the anodes to provide a more uniform electrolyte composition and are spaced from the cathodes, so that the lines of current reach the cathode in a parallel uniformly distributed configuration and produce better deposits of the metal to be recovered on the cathode.

Valve metals (sometimes also referred to as film forming metals) such as titanium, zirconium, hafnium, vanadium, niobium, tantalum, molybdenum and tungsten, or alloys thereof, have the capacity to conduct current in the anodic direction and to resist the passage of current from the cathodic direction and are sufficiently resistant to the electrolytes and the conditions in an electrowinning cell that substantially no corrosion takes place even during periods of current interruption or cell shut down. The valve metals, however, will not conduct current to the electrolyte unless provided with a non-passivating electrocatalytic surface or coating such as a coating containing a platinum group metal oxide or a self-generating alloy coating which is electrocatalytic in the electrolyte with reference to the release of oxygen or chlorine without excessive overvoltage.

In many of the processes of electrowinning metals from solutions containing the said metals, in order to produce satisfactory metal deposits on the cathodes, it is necessary to operate the process at relative low cathodic current density. If the cathode current density for a specific metal, the specific electrolyte composition, the cell geometry, etc., exceeds that at which smooth adherent deposits are formed on the cathode, the cathode current density limit is exceeded and roughened cathode deposits are produced which can occlude electrolytes which contaminate the deposited metal. If the cathodic deposit is of a dendritic nature, short circuits may be formed in the cell. If lead or lead alloy anodes are used, a slow dissolution of both the lead and its alloying elements occurs and the corrosion products are deposited on the cathode and contaminate the metal being won. At higher cathode current densities, these conditions are aggravated and in addition the potential of the electrowinning cell rises and hydrogen is liberated at the cathode causing further complications. "Cathode current density" at which hydrogen is liberated at the cathode is defined as the limiting cathode current density and the current density at which the cathode deposits become rough and striated is defined as the cathode current density limit. It is usually lower than the limiting cathode current density. There is, thefore, a well defined limited cathodic current density which may be used.

High production rates are, however, necessary in order to produce high yields of pure easily recoverable metal with a minimum expenditure of electrical energy.

BACKGROUND OF THE INVENTION

So called "insoluble lead or lead alloy" anodes have been used in electrowinning for many years. However, these anodes are slightly soluble and contaminate the electrodeposited metal which is being won. For example, the 84% lead, 14.5% antimony, 0.6% silver alloy anodes used in the Chuquicamata, Chile electrowinning plant, which last from six to eight years in service, have a corrosion rate of 0.6 to 2.5 kilos per ton of copper recovered. At the end of the useful life of these anodes, only 14% of the original weight remains and is recovered as scrap. Most of the lead going into solution in the electrolyte is deposited with the recovered copper. The use of rod type lead anodes and higher anode vs. cathode current density, as described, for example, in the Carosella U.S. Pat. No. 2,766,168 reduces the corrosion rate of the lead based anodes but does not eliminate it.

Likewise when titanium base anodes coated with platinum or platinum group metals are used in electrowinning, the platinum group metals are dissolved and, in addition to the expense of these anodes, the dissolved metals contaminate the metal being deposited on the cathodes.

The use of non-corrodible, dimensionally stable valve metal anode bases, such as titanium, zirconium, hafnium, vanadium, niobium, tantalum and molybdenum having conductive non-passivating surfaces and electrocatalytic properties for oxygen or chlorine discharge at low overvoltages, gives substantial advantages over the graphite, lead, lead alloy, silicon, iron and platinum anodes heretofore used in electrowinning, but to economically use these valve metal anodes for electrowinning, they must be operated at higher current densities than the permissible cathode current densities.

OBJECTS OF THIS INVENTION

One of the objects of this invention is to provide methods for electrowinning various metals in which non-corrodible dimensionally stable anodes are used and in which a higher anodic current density relative to the cathodic current density is used to more economically produce relatively pure metal deposits of the desired crystalline structure and purity on the cathodes.

Another object is to provide apparatus by which the above defined methods can be economically carried out.

Another object of the invention is to provide electrolysis cells for use in electrowinning in which high current densities can be applied at the anodes and lower current densities at the cathodes, so that relatively pure, smooth metal deposits can be produced on the cathodes with minimum expenditure of electrical energy.

Another object is to provide an electrowinning cell and method of operating said cell, in which spaced rod or strip non-corrodible anodes are used having a surface area of from 1.5 to 20 times less than the active surface area of the cathodes, whereby a greater current density can be applied to the anodes without exceeding the current density at which the cathodes produced good metal deposits and whereby the electrolyte can circulate freely through the rods or holes of the anodes to provide more uniform electrolyte compositions.

Another object is to provide dimensionally stable non-corrosive valve metal anodes for electrowinning which are substantially free from warpage or distortion in service and on which the electrocatalytic conductive surface does not contaminate the electrolyte or the metal electrodeposited on the cathode.

Various other objects and advantages of this invention will appear as this description proceeds.

In most electrowinning processes, copper, zinc, nickel, cobalt, manganese, iron, lead, tin, cadmium, etc. are electrodeposited on the cathode from sulfate solutions of the metal to be won, but in some cases chloride solutions, for example, nickel chloride solutions, may be used and in other cases, a combination of sulfate and chloride solutions may be used. The acids usually used to dissolve the metals are sulfuric acid or hydrochloric acid or sometimes a combination of sulfuric and hydrochloric acid. When the solvent acid is $H_2SO_4$, oxygen is liberated at the anodes, the metal is deposited on the cathode and the metal depleted acid is recycled to dissolve more metal from the ore, mine, dump or other source. When a chloride solution is used, chlorine is liberated at the anode.

The metals may be dissolved from ore, calcined ore, residue slag, scrap, underground deposits or other sources. If the solution contains contaminating metals which would deposit on the cathode, with the metal to be won, the contaminates are removed by the use of percipitants, sequestration agents or in other ways now used in electrowinning processes.

The non-corrodible dimensionally stable anodes used in our process are preferably titanium or other valve metals or alloys provided with a conducting-non-passivating electrocatalytic surface which may be an oxide or a mixture of oxides of the platinum group metals, i.e., platinum, iridium, palladium, ruthenium and osmium, applied as a coating to the surface of the valve metal, as described, for example, in British Pat. Nos. 1,147,442 and 1,195,871, or the electrocatalytic material may be incorporated as an alloy layer of bronze oxides in the surface of the valve metal anode as described in U.S. Pat. No. 3,878,083. If portions of these coatings are dislodged or dissolved into the electrolyte, their characteristics are such that they are much less likely to deposit upon the cathode or contaminate the electrowon metal than the lead anodes of the prior art.

The valve metal anodes may be in the form of solid or reticulated sheets of, for example, titanium, or in the form of rods, bars or other arrangements, but in all instances the anode area facing the cathode should be 1.5 to 20 times smaller than the opposed cathode surface area and should be operated at a current density of 1.5 to 20 times higher than the cathode current density. The surface or coating of the anodes should have a high electrocatalytic activity for oxygen evolution in sulfate electrolytes or for chlorine evolution in chloride electrolytes.

The electrocatalytic coated dimensionally stable valve metal anodes of this invention are still active at 30 KA/sq. mt, after 2 to 3.5 years of anodic operation in chloride solutions with an anode potential ranging from 1.35 to 1.50 V(NHE) and in 10% (by weight) $H_2SO_4$ solutions, the bronze oxide coatings are still active at 0.6 to 1.2 KA/sq.mt; after more than one year of anodic operation with an anode potential ranging between 1.5 to 1.6 V(NHE), whereas lead and lead alloy anodes at the same working conditions show anode potentials greater than 1.98 V(NHE). If these dimensionally stable anodes become passivated, they can be cleaned and recoated at a small expense.

The anodes of this invention under the operating conditions hereinafter described produce cathode deposits free of contamination, whereas lead, lead alloy and titanium coated with noble metals produce cathode contamination in sulfate solution electrolyses. Owing to the low overpotential of these anodes, oxidation of $Ni^{+2}$ and $Co^{+2}$ to $Ni^{+3}$ and $Co^{+3}$ does not occur in either sulfate or chloride solutions.

The use of dimensionally stable metal anodes with reduced anodic surface allows a more economical employment of anode materials for all those electrolytic processes for which a limit is imposed on the current density by other considerations than the anodic current density capability, in particular where the cathodic current density limit value is largely below the maximum current density economically acceptable by the dimensionally stable metal anodes.

The anodic structures with reduced surface, represented by this invention are the result of an extensive theoretical and experimental research carried out to determine the most efficient geometric configurations for anodes that allow the maximum saving in anodic material while maintaining substantially unchanged the overall efficiency of the electrolytic process.

In many electrolytic processes, and particularly in electrowinning and electrorefining of metals, to obtain a cathodic deposit of uniform thickness, the electric current must be uniformly distributed over the cathodic surface. Thus uniformity is achieved when the "lines of current", emanating normally from the surface of the anodic structure, assume a parallel and uniformly disposed configuration before reaching the plane cathodic surface at a normal direction of incidence. It is obvious that the interelectrodic distance or electrode gap has an essential bearing and it is one of the geometric parameters of the invention. The geometric parameters, controlling the achievement of the optimum conditions required by the process and allowing the maximum saving of anodic materials, are a combination of the geometric configuration of the anodic structure, the interelectrodic distance and the shape and cross section of the members which constitute the reduced surface anode structure. In general, the electrode gap should be between 20 and 150 mm depending on the composition of the electrolyte, the anode configuration, the current density, the ohmic voltage drop in the electrolyte and in the anode structure, and other factors prevailing in a specific electrowinning plant.

By careful choice of each of the controlling parameters, it is possible to operate an electrometallurgical process with anodes having an anodic surface down to 20 times smaller than the cathodic surface and therefore working at a current density 20 times higher than the cathodic current density.

Special care must be exercized to distribute the electric current to the anodic structure so as to minimize the ohmic drop along the members of the anodic structure which have reduced cross sectional areas. Current is, hence, supplied at several points on the structure in relation to the geometric and dimensional characteristics of the anode.

In the accompanying illustrative drawings, one embodiment of an apparatus and process for practicing this invention is illustrated, but it will be clear to persons skilled in the electrowinning of metals that the process can be carried out in other types of electrolysis cells and by other equivalent methods.

Figure 1:
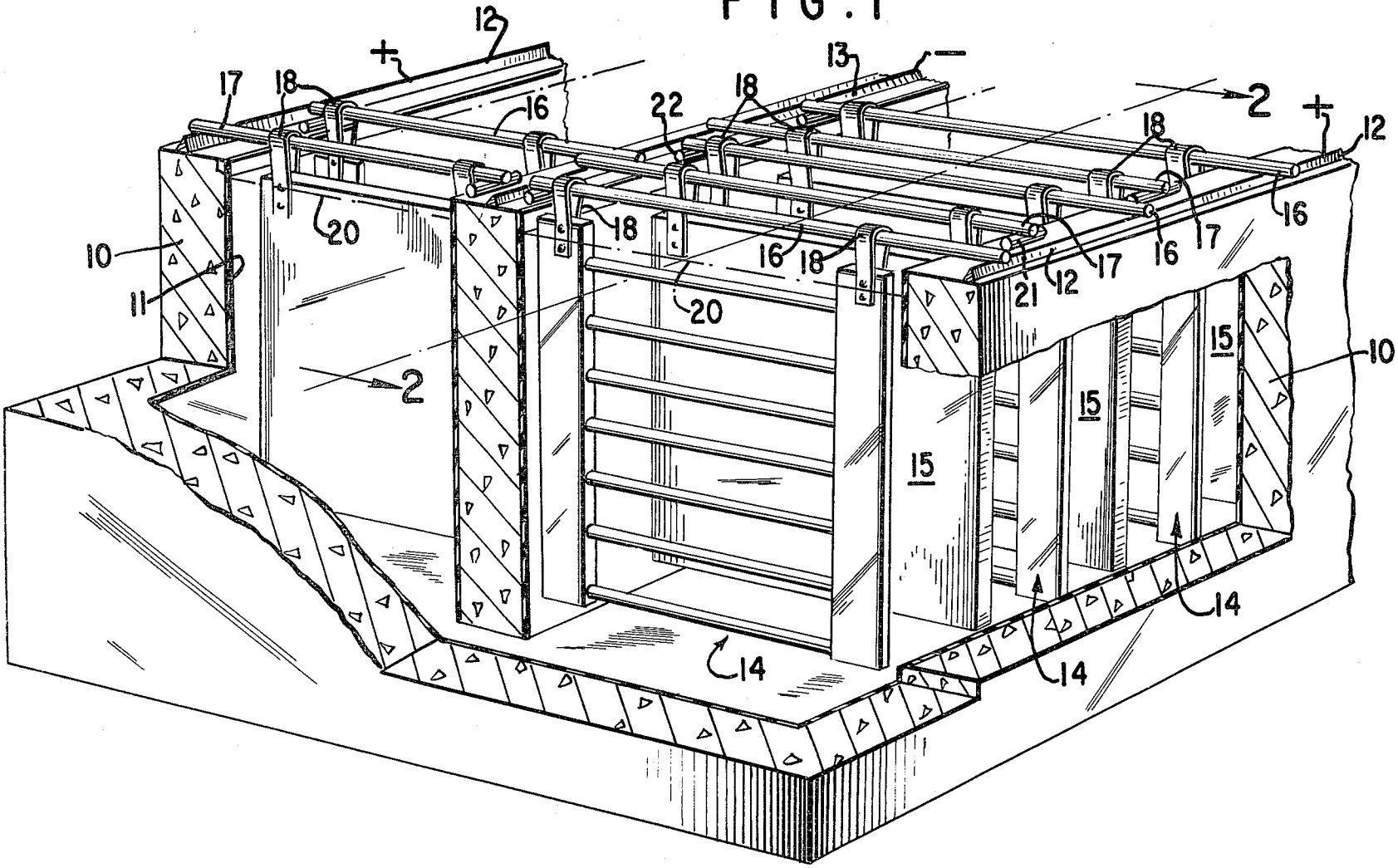
FIG. 1 is a diagrammatic perspective view of a typical electrowinning cell.
Figure 2:
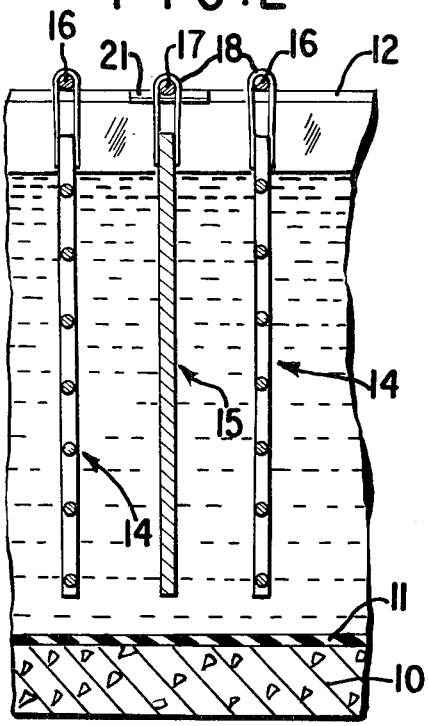
FIG. 2 is a cross sectional view along the line 2—2 of FIG. 1, in which the anodes are in the form illustrated in FIG. 6.
Figure 5:
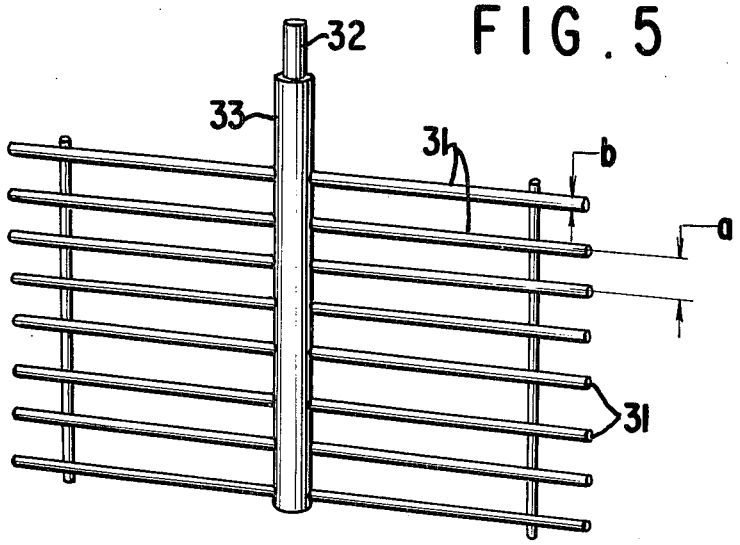
Figure 6:
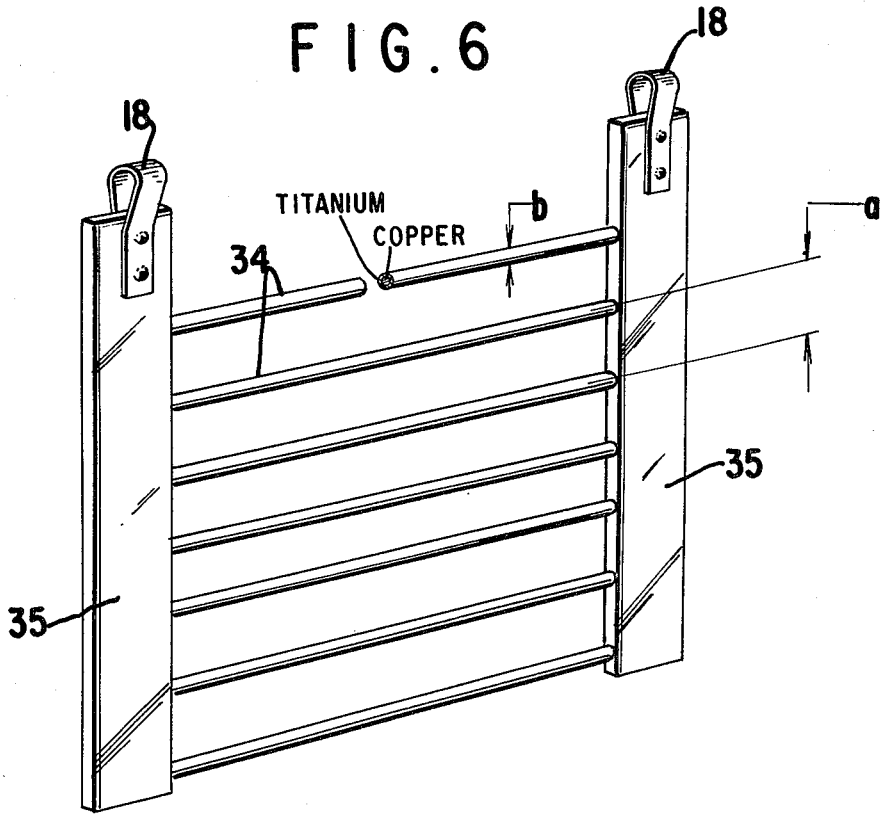
Figure 7:
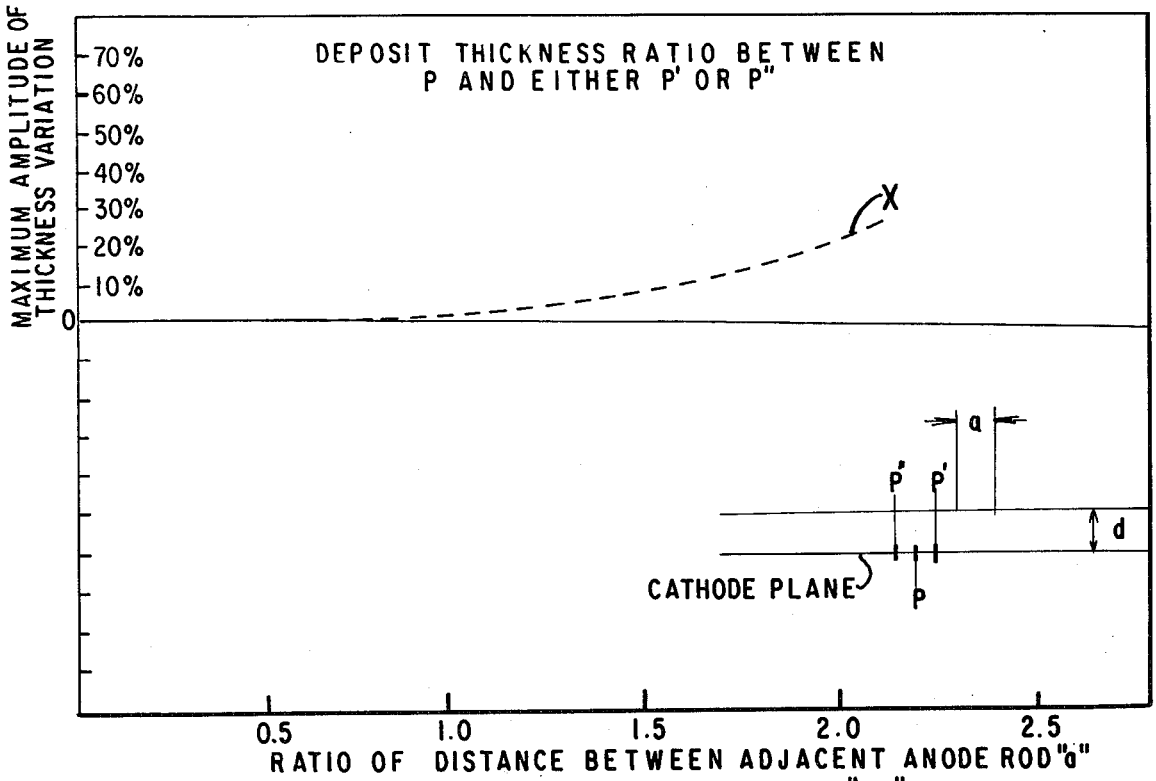
Figure 8:
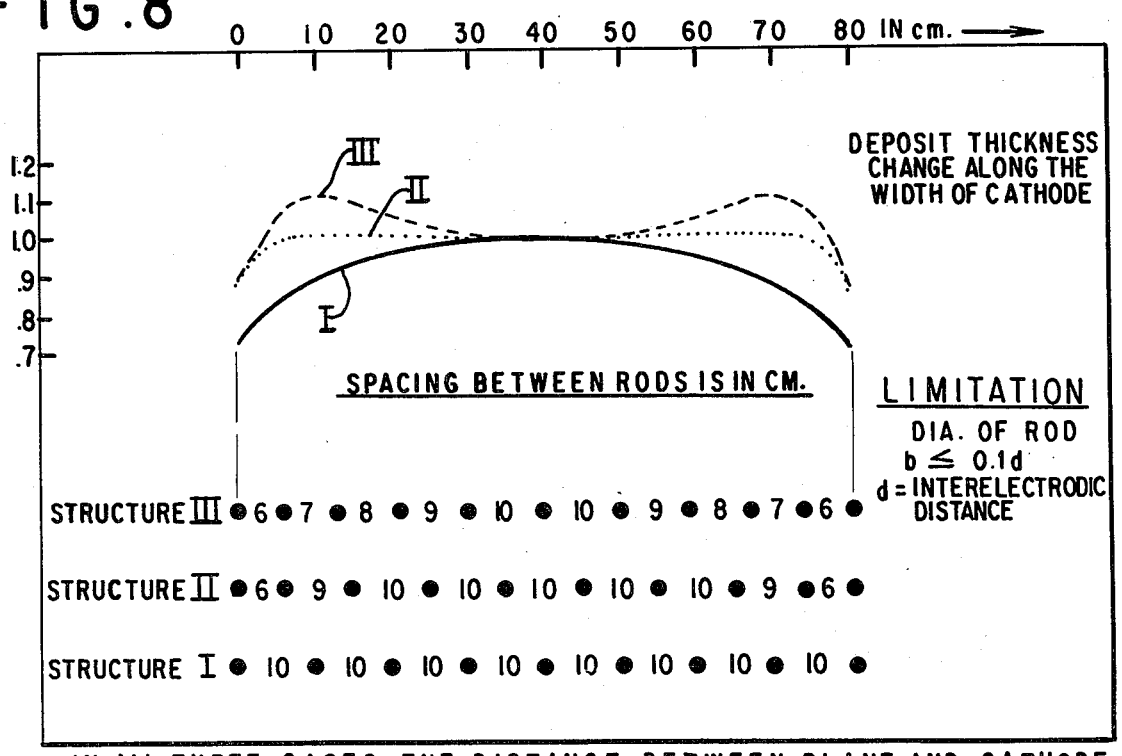

FIGS. 3, 4, 5 and 6 are diagrammatic perspective views of various forms of dimensionally stable anode constructions which may be used in the cells of FIGS. 1 and 2 or in other electrowinning cells; and FIGS. 7 and 8 are illustrations of one set of cell conditions designed to produce the best form of cathode deposit for the specific anode configuration diagrammed in these figures.

The illustrative cells of FIGS. 1 and 2 comprise tanks 10 which may be made of concrete or any other suitable material, lined with rubber or other suitable inert material 11. Tanks 10 are provided with positive bus bars 12 and negative bus bars 13 through which direct electric current from a source not shown, is supplied to anodes 14 and cathodes 15 via contact bars 16 and 17, respectively, and anode and cathode straps 18. Electrolyte 20 containing a solution of the metal to be won is continually pumped into and out of the tanks 10 as the electrolyte is depleted in metal values by electrodeposition on cathodes 15. Tanks 10 are arranged in parallel and the electrolyte flow may be as desired.

Electrolytic cells of this type are most frequently connected in series with each cell containing one more anode than cathodes, so that each cathode is faced by an anode at each side of the cathode. Series arrangement of the electrolytic cells is effected by placing tanks 10 side by side, so that, for example, current flowing through bus bar 12 is conducted through anode contact bars 16 and anodes 14 and in each direction from the anodes through electrolyte 20 to cathodes 15 and through cathode straps 18, contact bars 17 and bus bars 13 to anode contact bars 16 for the immediately adjacent electrolytic cell. Contact bars 16 and 17 are supported at opposite ends by non-conducting supports 21 and 22, respectively, to insure that the electrodes are in a level position and to insure the desired parallel circuits for the current.

Anodes 14 shown in FIGS. 1 and 2, have a spaced bar form, similar to that shown in FIG. 6 and described in greater detail below, which is advantageous for the practice of the present invention. Although the present invention is not limited to any particular anode dimensions or specific anode shape, a typical example given solely for the purpose of illustrating the invention is an anode structure having spaced rods, bars or strips illustrated and described below, having an active surface area from 1.5 to 20 times smaller than the opposed active surface area of the cathodes and operating at a current density of from 1.5 to 20 times higher than the current density on the opposed active cathodes surface.

Figure 3:
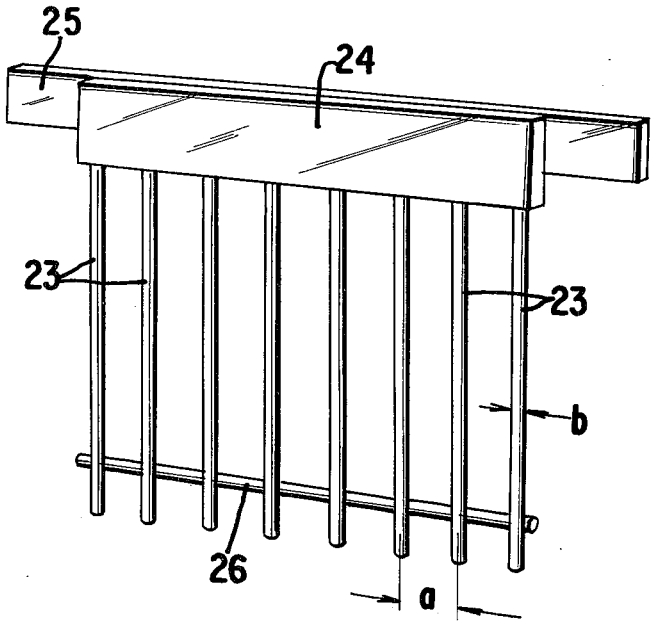

FIG. 3 shows a substantially planar anodic structure, with reduced anodic surface, made from a series of parallel rods 23, vertically disposed and widely separated from one another, connected to a horizontal bar 24 which sustains them and distributes the electric current to the same. The horizontal bar 24 is electrically connected to the positive supply bus bar 25 or to anode contact bars 16 of FIGS. 1 and 2 which are connected to the electric current source. A horizontal bottom bar 26 joins the lower ends of the rods 23 to maintain a fixed separation pitch and to equalize eventual potential differences between the anodic rods 23. Bars 24 may be provided with straps similar to straps 18 for connection to anode contact bars 16 of FIG. 1.

Figure 4:
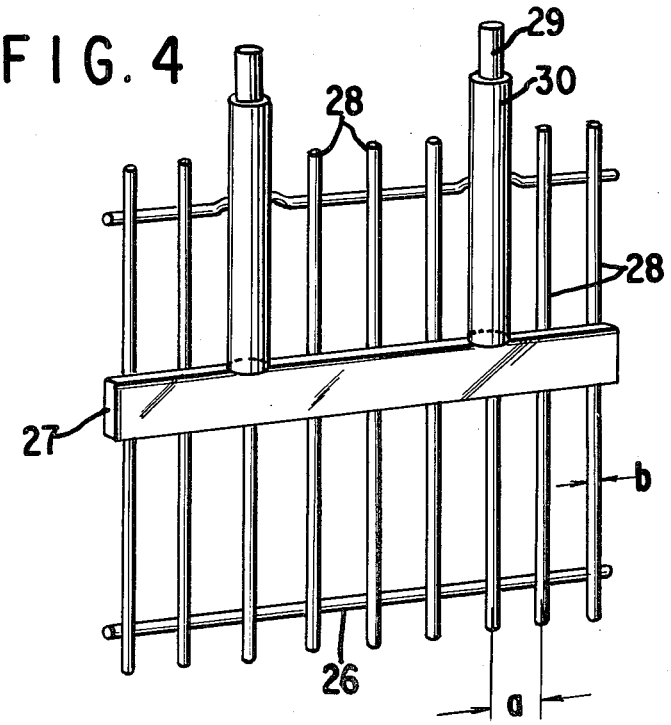

FIG. 4 illustrates another example of substantially planar anodic structures made according to the invention. In this embodiment, the electrical supply bar 27 is in a central position with respect to the length of anodic rods 28. In this way the average path of the electric current in the structure is halved and a lower ohmic drop is achieved. conductors 29 can be made of different material, such as copper or aluminum and may be sealed off from the electrolyte by a protective sheath 30 resistant to the corrosive environment found inside the cell. Conductors 29 distribute the electric current at several points along the supply bar 27 to minimize the ohmic drop.

FIG. 5 represents an anodic structure comprising a series of parallel anodic rods 31 horizontally disposed and connected to a central vertical supply bar 32 which consists of a round bar of highly electroconductive material such as copper or aluminum to which are connected the ends of the anodic rods 31. The supply bar 32 is sealed from the electrolyte by a protective sheath 33.

FIG. 6 shows anodic rods 34 horizontally disposed and connected at both ends to vertical supply bars 35, which extend vertically inside the electrolytic bath and are connected by straps 18 to anode contact bars 16 (FIG. 1) or to a cable connected to the positive terminal of an electric source. In this embodiment, the path of electric current along the anodic rods 34 is halved with respect to their length. In FIGS. 3 to 6, the anodic rods may be round, square, rectangular with convex sides, oval or any other shape, or they may be flat strips of titanium or other valve metal in reticulated mesh or screen form provided with a conducting electrocatalytic coating. However, the preferred shape of the rods is the round section. The anode rods may be ununiformly spaced along the width of the anodes, such as more widely spaced toward the center and more closely spaced toward the ends of the anodes, to counteract the edge effect of the cathode deposits, and they may be diagonally sloped instead of horizontal or vertical, as illustrated in FIGS. 3 and 6. The anode configuration which gives the best and most uniform deposits on the cathodes under the conditions of a specific electrowinning operation should be used. The values of geometrical parameters a and b in FIGS. 3 to 6, namely, the spacing and diameter of the rod, may vary within wide limits depending on the interelectrodic distance and the maximum anodic-cathode current density ratio which is to be used.

The rods 14-23-28, 31 and 34 are formed of a valve metal which in an electrolyte conducts electric current in one direction and does not conduct current in the opposite direction. Metals such as titanium, zirconium, hafnium, vanadium, niobium, tantalum, etc., may be used, but we prefer to use titanium. The rods may be copper cored titanium rods as shown in FIG. 6, which have a high conductivity and may be detachably screwed into the horizontal or vertical bars 24–27 or 35 and detachably connected to the horizontal rods 26. The rods 14–23, etc., may be flat strips of metal, strips of reticulated expanded metal or bars of any suitable shape.

The valve metal rods 23-28-31-34 are coated with a conductive electrocatalytic coating containing at least one metal of the group consisting of gold, platinum, silver, palladium, iridium, ruthenium, osmium, rhodium, iron (magnetite), nickel, chromium in the form of oxides, nitrides, carbides and sulfides of said metals.

The conductive electrocatalytic coating on rods 23-28-31 preferably contains at least one platinum group metal oxide and at least one oxide from the group consisting of titanium, tantalum, zirconium, hafnium, vanadium, niobium, iron, nickel, tin, aluminum, cobalt and chromium.

The conductive electrocatalytic surface on the anode rods 23, 28, 31, 34, etc., is preferably composed of a major portion of titanium dioxide ($TiO_2$) or tantalum pentoxide ($Ta_2O_5$) together with a minor portion of an oxide of a platinum group metal capable of catalyzing chlorine or oxygen discharge at the surfaces of the anode rods. Other electrocatalytic active surfaces may be used. We have found surfaces containing tantalum pentoxide and iridium oxide in the ratio of 1:1 to 0.34:1 of tantalum to iridium, calculated as metal, with or without other oxides which improve the semi-conductivity of the surface, to be particularly effective. Instead of rods or bars 23, 28, 31, etc., perforated flat titanium strips or other shapes having a small surface area with reference to the cathode surface area may be used and the rods, bars or strips may be tapered or of reduced cross section toward their lower end to produce different current density toward the bottom portion of the cathodes.

For each electrowinning installation, the anode configuration which will give the most uniform and best cathode deposit should be used. The best anode configuration for a specific set of cell operating conditions can be readily determined by persons skilled in the electrowinning art by a few simple electrodeposition experiments with the electrolyte and cell conditions to be used in the specific electrowinning plant in which the process and apparatus of this invention are to be used.

FIGS. 7 and 8 show diagrammatically how these conditions can be determined for one specific set of operating conditions.

ILLUSTRATION A

The ratio of the distance between rods a and the interelectrodic gap d to maintain a good degree of uniformity of the deposit on a flat cathode has been summarized for different sets of operating conditions in the diagram of FIG. 7. This diagram illustrates how the ratio expressed in percent of deposit thickness between two representative points, near the middle of the cathode width, between a point on the cathode directly opposite an anode rod and an adjacent point on the cathode directly underneath the midpoint between adjacent anode rods, varies with varying ratios of a/d.

In all cases, the distance d was kept constant at 100 mm and the spacing of the rods a along the anode was changed, the diameter b of the rods was small with respect to d (i.e., $b \leqq 0.2d$), and the influence of the rod diameters on the deposit thickness uniformity was neglibible.

The curve x tends to become steeper when anode structures having overall width smaller than about 10 times the interelectrode distance where used and to flatten slightly when anodic structures having increasingly larger overall widths are used, which fact is explained by intervening edge effects.

The results indicate that an optimum ratio of a/d of about 1.5 or 2.0 is quite satisfactory, especially for wide anodic structures.

The edge effect of the anode to the cathode is summarized in the diagram of FIG. 8. The results illustrated are for the specific case of an anodic structure having an overall width of 800 mm and constituted by a series of spaced round anode rods 5 mm in diameter.

The interelectrodic gap was 100 mm in the case of Structures I, II and III. Structure I had a uniform distance between rod a centerpoints of 100 mm, the profile of the deposit thickness of the cathode's surface is represented by curve I. As can be seen, near the edge of the cathode plate, the thickness is down to about 0.7% of the thickness at the centerpoint which made the cathode deposit unsatisfactory.

Structure III had an evenly decreasing spacing between the anode rods towards the edge of the structure, namely, 100 mm at the center of the anode structure and 90 mm, 80 mm, 70 mm and 60 mm, progressive spacings of the rods from the center rods toward each outer edge of the anode. This produced a deposit profile represented by curve III.

The optimum condition was approached with Structure II, characterized by ten anode rods spaced from edge to edge, as follows:

60 mm, 90 mm, 100 mm, 100 mm, 100 mm, 100 mm, 100 mm, 90 mm, 60 mm.

The profile of the cathodic deposit thickness obtained is illustrated by curve II and it is effectively comparable with the profile obtained using an integral plate anode.

The illustration of diagram 8 is true for only one set of ratios of anode rod spacing a and interelectrodic gap d. For each variation of these ratios, different variations in the thickness of the cathodic deposit may be secured. The optimum ratio for a given set of operating conditions can be readily determined by persons skilled in the electrowinning art and should be determined in advance for the conditions prevailing for each electrowinning in which the principles of this invention are to be used.

The most satisfactory value of the distance a is between 10 and 100 mm; the diameter b of the anodic rods is between 2 and 16 mm. The interelectrodic gap may be from 20 mm to 150 mm.

In practicing the processes of this invention, the anodic current density should be at least 450 $A/m^2$ and the corresponding cathodic current density would be 300 $A/m^2$ or less. The cathode current density should also be in excess of 22 $A/m^2$ greater than that tolerable when lead anodes are used. Where the anodic current density is 450 amps per sq. meter, the cathodic current density may be 300 $A/m^2$ or less.

EXAMPLE 1

Nickel was electrodeposited from an electrolyte solution containing $NiCl_2$ and using an anode structure similar to the one illustrated in FIG. 3. The uniform center spacing a was 60 mm, reduced to 50 mm and 45 mm for the two extreme end rods of the anode. The diameter of the anode rods b was 6 mm.

The operational test conditions were the following:

| | |
|---|---|
| Electrolyte: $NiCl_2$ | 80 gpl as metallic Ni |
| Current density (cathodic) | 300 $A/m^2$ |
| Current density (anodic) | 2,000 $A/m^2$ |
| Cathode dimensions | 600 mm × 400 mm |
| Overall dimensions of anodic | 550 mm × 350 mm |

-continued

| | |
|---|---|
| Structure | |
| Immersed surface area of anode | 31,000 $mm^2$ |
| Cathodic material | Stainless Steel AISI 316 |
| Anode base material | Titanium |
| Interelectrodic distance | 80 mm |
| Temperature | 60° to 80° C |
| Buffering agent | $H_3BO_3$; 20 to 40 gpl |

An asbestos diaphragm 1.5 mm thick was used to separate anolyte from catholyte compartments. The cathode was between two anodes. 6 mm of nickel were deposited over both faces of the flat cathode operating at high efficiency. The quality of the deposit obtained was very good; the metallic deposit was free from dendrites, of uniform thickness and mechanically stable.

EXAMPLE 2

Copper was electrodeposited from an electrolyte solution containing $CuSO_4$, using an anode structure similar to the one illustrated in FIG. 4. The uniform center spacing a of the rods 25 was 35 mm, reduced to 30 mm and 25 mm for the two extreme rods of the structure, and the diameter of the anode rods b was 5 mm.

The operation conditions were the following:

| | |
|---|---|
| Electrolyte: $CuSO_4$ | 40 gpl as metallic Cu |
| $H_2SO_4$ | 150 to 200 gpl |
| Current density (cathodic) | 300 $A/m^2$ |
| Current density (anodic) | 1,300 $A/m^2$ |
| Cathode dimensions | 700 mm × 400 mm |
| Overall dimensions of anodic Structure | 670 mm × 390 mm |
| Immersed surface area of anode | 64,500 $mm^2$ |
| Interelectrodic distance | 90 mm |
| Temperature | 60° to 80° C |

6 mm of copper were deposited over both faces of the flat cathode at a high overall efficiency. The quality of the deposit was very good; the deposit was substantially free from dendrites and had good mechanical stability. the thickness was substantially uniform over the entire cathodic surface.

EXAMPLE 3

Zinc was electrodeposited from an electrolyte solution containing $ZnSO_4$, using an anode structure similar to the one illustrated in FIG. 5. The uniform center spacing a was 30 mm, reduced to 28 mm and 22 mm for the two extreme rods at the top and bottom of the structure, and the diameter of the anode rods b was 6 mm.

The operational test conditions were the following:

| | |
|---|---|
| Electrolyte: $ZnSO_4$ | 60 gpl as metallic Zn |
| $H_2SO_4$ | 150 to 200 gpl |
| Current density (cathodic) | 300 $A/m^2$ |
| Current density (anodic) | 1,000 $A/m^2$ |
| Cathode diemnsions | 600 mm × 400 mm |
| Overall dimensions of anodic Structure | 580 mm × 390 mm |
| Immersed surface area of anode | 72,000 $mm^2$ |
| Interelectrodic distance | 80 mm |
| Temperature | 30° to 35° C |

3 mm of zinc were deposited over both faces of the flat cathode at high overall efficiency. The quality of the deposit was very good; the deposit was substantially free from dendrites and had good mechanical stability. The thickness was substantially uniform over the entire cathodic surface.

EXAMPLE 4

Cobalt was electrodeposited from an electrolyte solution containing $CoSO_4$, using an anode structure similar to the one illustrated in FIG. 5. The uniform center spacing a was 35 mm, reduced to 30 mm and 25 mm for the two extreme rods of the structure, and the diameter of the anode rods b was 5 mm.

| | |
|---|---|
| Electrolyte: $CoSO_4$ | 80 gpl as metallic Co |
| $H_2SO_4$ | To a pH of 2 |
| Current density (cathode) | 300 $A/m^2$ |
| Current density (anodic) | 1,300 $A/m^2$ |
| Cathode dimensions | 700 mm × 400 mm |
| Overall dimensions of anodic Structure | 670 mm × 390 mm |
| Immersed surface area of anode | 64,500 $mm^2$ |
| Interelectrodic distance | 90 mm |
| Temperature | 60° to 80° C |

The cathodes were between two anodes. 6 mm of cobalt were deposited over both faces of the flat cathode at a higher overall efficiency. The quality of the deposit was very good; the deposit was substantially free from dendrites and had good mechanical stability. The thickness was substantially uniform over the entire cathodic surface.

EXAMPLE 5

Nickel was electrodeposited from an electrolyte solution containing $NiSO_4$, using an anode structure similar to the one illustrated in FIG. 5. The uniform center spacing a was 35 mm, reduced to 30 mm and 25 mm for the two extreme rods of the structure, and the diameter of the anode rods b was 5 mm.

| | |
|---|---|
| Electrolyte: $NiSO_4$ | 80 gpl as metallic Ni |
| $H_2SO_4$ | To a pH of 2 |
| Current density (cathodic) | 300 $A/m^2$ |
| Current density (anodic) | 1,300 $A/m^2$ |
| Cathode dimensions | 700 mm × 400 mm |
| Overall dimensions of anodic Structure | 670 mm × 390 mm |
| Immersed surface area of anode | 64,500 $mm^2$ |
| Interelectrodic distance | 90 mm |
| Temperature | 60° to 80° C |

6 mm of nickel were deposited over both faces of the flat cathode at a high overall efficiency. The quality of the deposit was very good; the deposit was substantially free from dendrites and had good mechanical stability. The thickness was substantially uniform over the entire cathodic surface.

The examples describe the applications of our invention to electrorefining or electrowinning. Anodes with reduced anodic surface combine the well known advantages of dimensionally stable metal anodes, such as the lower energy consumption, high purity of the metallic deposit, freedom from warpage and operational long life with a reduced investment cost.

Anodes with reduced anodic surface may be used in other electrolytic processes where conditions exist such that the cathodic current density is limited by other considerations than the current density capability of the anode and where there is a valuable possibility of economizing on the cost of the rather expensive materials necessary to fabricate dimensionally stable metal anodes, such as organic electro-oxidation and electroreduction processes in electroflotation processes, etc.

The terms "spaced rods" or "spaced conducting electrocatalytic surfaces" as used in the following claims are intended to include spaced rods, bars, flat strips of metal, strips of reticulated expanded metal, bars of any suitable shape, perforated flat titanium strips or other shapes, having a small conductive surface area with reference to the cathode surface area.

What is claimed is:

1. The method of recovering metal from an aqueous acid solution containing the metal to be recovered, which comprises electrolyzing said solution in an electrolytic cell between an insoluble metal anode formed of spaced rods having a non-corrodible metal base and conducting electrocatalytic surfaces, and a solid cathode onto which the metal is deposited, in which the active conducting surface area of the anode facing the cathode with reference to the active cathode conducting surface area is at least 1.5 to 20 times less than the active area of the cathode, the anode current density with reference to the cathode current density is at least 1.5 to 20 times greater than the cathode current density and the anode rods are spaced uniformly in the mid-portion of the anode structure and closer together at the extremities of the anode structure to produce substantially uniform thickness deposits of the metal to be won over the entire active surface of the cathode.

2. The method of claim 1, in which the spacing of the anode rods with reference to the width of the interelectrodic gap is an optimum of 1.5 to 2.0 and the conducting electrocatalytic surfaces contain an oxide of at least one platinum group metal.

3. The method of claim 2, in which the surfaces contain at least one oxide of a platinum group metal and at least one oxide of a non-precious metal.

4. The method of claim 2, in which the electrolysis is carried out at an anodic current density of at least 450 $A/m^2$.

5. The method of claim 1, in which the anode rods are spaced unequal distances along the anode and are diagonal with reference to the vertical direction of the cathode.

32. An electrowinning method which comprises establishing a bath of an aqueous acid electrolyte having dissolved therein at least one electrodepositable metal; immersing a substantially solid cathode and an insoluble non-corrodible valve metal anode of slightly less length and width than the length and width of the cathode in the electrolyte in a generally vertical direction to form an electrolytic cell; providing the anode with spaced conducting electrocatalytic surfaces containing a platinum group metal oxide, said anode conducting surfaces being spaced unequal distances apart with reference to the width of the interelectrodic gap in the mid-portion of the cathode and near the edges of the cathode, to produce substantially uniform thickness deposits on the mid-portion of the cathode and on the edges of the cathode, and said conducting surfaces being between 1.5 and 20 times less than the conducting surface of the cathode, within the reduced length and width of the anode; and using an anode current density between 1.5 and 20 times greater than the current density on the cathode to produce smooth adherent deposits of substantially uniform thickness of said metal on the cathode.

12. The method of claim 6, in which anodes in the form of spaced rods are used, the rods are between 2 and 16 mm in diameter, the center spacing of the rods is between 10 and 100 mm and is unequal along the anode and the interelectrodic gap is 20 to 150 mm.

6. The method of recovering metal from an aqueous acid solution containing the metal to be recovered, which comprises electrolyzing said solution in an electrolytic cell between an insoluble metal anode having a noncorrodible valve metal base with spaced active conducting electrocatalytic surface areas, and a cathode onto which the metal is deposited, in which the spaced active conducting surface areas of the anode facing the cathode with reference to the active conducting cathode surface area is at least 1.5 times less than the active conducting surface area of the cathode, the anode current density with reference to the cathode current density is at least 1.5 times greater than the cathode current density, the active conducting surface areas of the anode are spaced unequal distances apart to produce metal deposits of substantially uniform thickness on the cathode, with the center spacing of the active conducting surface areas of the anode facing the mid-portion of the cathode being spaced apart approximately the width of the interelectrodic gap and the conducting surface areas of the anode toward the edges of the cathode being closer together.

7. The method of claim 6, in which the anode comprises a valve metal base and has electrically conducting electrocatalytic surfaces thereon containing an oxide of at least one platinum group metal, and the ratio of the center spacing to the interelectrodic gap at the mid-portion of the cathode is 1.1 and toward the edges of the cathode from 0.6 to 0.9 to 1.

8. The method of claim 7, in which the surfaces contain at least one oxide of a platinum group metal and at least one oxide of a valve metal.

9. The method of claim 6, in which the electrolysis is carried out at an anodic current density of at least 450 $A/m^2$.

10. The method of claim 6, in which the ratio of active anode surface area to active cathode surface area is at least $\frac{1}{3}$.

11. The method of claim 6, in which the cathode current density is in excess of 22 $A/m^2$ greater than that tolerable when lead anodes are used.

13. The method of electrowinning which comprises providing a tank; a metal-containing aqueous acid electrolyte in said tank; at least one cathode substantially vertically immersed in said electrolyte; at least one anode insoluble in said electrolyte substantially vertically immersed in said electrolyte and spaced from the cathode; said anode comprising a series of spaced bars of a valve metal having an electrically conductive electrocatalytic surface; said cathode having a surface area substantially greater than the anode surface area; applying a direct current to the anode and the cathode at an anodic current density of from 1.5 to 20 times higher than the cathodic current density; spacing the bars at unequal distances along said anode, with the widest spacing at the mid-portion of the anode being approximately equal to the width of the interelectrodic gap and the narrowest spacing near the edges of the anode being less than the width of the interelectrodic gap, to electrodeposit the metal in said electrolyte on the cathode as a smooth, relatively pure metal deposit of relatively uniform thickness from edge to edge of the cathode and substantially free of contamination from the metals of said anode.

14. An electrowinning method according to claim 13 which comprises spacing the axes of said bars between 10 mm and 100 mm apart, providing bars having a diameter between 2 and 16 mm, spacing the bars at unequal distances from one outer edge to the other outer edge of said anodes, and maintaining the distance between said bars and the cathode between 20 and 150 mm.

15. The electrowinning method of claim 13 which comprises providing bars of said anode between 2 and 16 mm in width, spacing said bars at unequal distances between 10 and 100 mm along said anode, maintaining the interelectrodic gap between said anode and said cathode between 20 and 150 mm and maintaining the ratio of the bar spacing to the interelectrodic gap between 0.3 to 1 and 2 to 1.

16. The method of electrowinning which comprises providing a tank; a metal-containing aqueous acid electrolyte in said tank; at least one cathode substantially vertically immersed in said electrolyte; at least one anode insoluble in said electrolyte substantially vertically immersed in said electrolyte and spaced from the cathode; said anode comprising a series of spaced bars of a valve metal having an electrically conductive electrocatalytic surface; said bars being between 2 and 16 mm in diameter; spacing said bars at unequal distances between 10 and 100 mm apart along said anode; said cathode having a surface area substantially greater than said anode; forming an interelectrodic gap of 20 to 150 mm in width between said anode and said cathode; passing a direct current to the anode and the cathode at an anodic current density of from 1.5 to 20 times higher than the cathodic current density; depositing the metal in said electrolyte on the cathode as a smooth, relatively pure metal deposit, of relatively uniform thickness, substantially free of contamination from the metals of said anode.

17. The method of electrowinning metals from an aqueous acid electrolyte containing values of the metals to be won, which comprises providing a tank for the electrolyte, at least one anode-cathode pair of electrodes, the anode of which has a reduced active surface area relative to the active surface area of the cathode amounting to not more than two-thirds to one-twentieth of the active surface area of the cathode, operating the anode at 1.5 to 20 times the cathode current density without exceeding the cathode current density limit, and providing said anode with an open-work structure of non-corrodible valve metals having an electroconductive, electrocatalytic surface thereon, said open-work structure having reduced active surface area in the mid-portion of said structure and greater active surface area near the edges of said structure to deposit substantially uniform thickness of metal on both the mid-portion and the edges of the cathode.

23. An electrowinning cell comprising a tank; a metal-containing aqueous acid electrolyte in said tank; at least one cathode substantially vertically immersed in said electrolyte; at least one anode insoluble in said electrolyte substantially vertically immersed in said electrolyte and spaced from the cathode; said anode comprising a series of spaced bars of a valve metal having an electrically conductive electrocatalytic surface; said cathode having an area substantially greater than said anode; a direct current source for supplying current to the anode and the cathode at an anodic current density of from 1.5 to 20 times higher than the cathodic current density; said bars being spaced at unequal distances along said anode with the widest spacing, at the mid-portion of the anode, being approximately equal to the spacing between the anode and the cathode and the narrowest spacing, near the edges of the anode, being less than the spacing between the anode and the cathode; to electrodeposit the metal in said electrolyte on the cathode as a smooth, relatively pure metal deposit of relatively uniform thickness from edge to edge of the cathode and substantially free of contamination from the metals of said anode.

26. The cell of claim 23 in which the electrocatalytic surface is a coating which contains an oxide of tantalum and an oxide of iridium.

27. The cell of claim 26, in which the electrocatalytic surface is a coating which in addition to at least one platinum group metal oxide contains at least one oxide from the group consisting of titanium, tantalum, zirconium, hafnium, vanadium, niobium, iron, nickel, tin, aluminum, cobalt and chromium.

25. The cell of claim 23, in which the portion of said anode bars exposed to the electrolyte is formed of a valve metal and said valve metal has an electrically conducting electrocatalytic surface thereon and the current source supplies electric current to the anode and the cathode at an anodic current density of from 4 to 20 times higher than the cathodic current density and at a cathode current density in excess of 22 $A/m^2$ greater than tolerable with lead anodes.

24. The electrowinning cell as described in claim 23, wherein said anode comprises a series of bars of a conductive valve metal alloy resistant to the corrosive cell conditions and having a surface which is catalytic with reference to the anodic process and the current source supplies electric current to the anode and the cathode at an anodic current density of from 3 to 20 times higher than the cathodic current density.

28. An electrowinning cell according to claim 23, in which the axes of said bars are spaced between 10 mm and 100 mm apart, the bars have a diameter between 2 and 16 mm and are spaced at unequal distances from one outer edge to the other outer edge of said anodes, with the widest spacing opposite the mid-portion of the cathode and the narrowest spacing opposite the edges of the cathode, and the distance between said bars and the cathode is between 20 and 150 mm.

29. The electrowinning cell of claim 23, in which the ratio of the distance between said bars and the distance of said bars from the cathode is between 0.3 to 1 and 2 to 1.

30. The cell of claim 23, in which the axes of said bars are spaced between 10 mm to 100 mm apart and the distance between said bars and the cathode is between 20 and 150 mm.

31. The cell of claim 23, in which the conducting electrocatalytic surface contains an oxide of at least one metal from the group consisting of platinum, palladium, iridium, ruthenium and osmium.

18. Metal anodes comprising a series of coplanar rods made of a metal alloy which is resistant to the corrosive environment of the cell, is electroconductive and electrocatalytic to the anodic reaction, said rods being unequally spaced along the plane of the anode with the widest spacing near the center of the anode plane and narrower spacing adjacent the edges of the anode plane, said rods being electrically connected to one or more electric current supply bars, said coplanar rods being parallelly disposed with a spacing between their axes of between 3 mm and 100 mm.

19. Metal anodes according to claim 18, in which the electroconductive core of the anodic rods is made of valve metal.

20. Metal anodes according to claim 18, in which the electroconductive core of the anodic rods is made of metal alloy containing at least a valve metal.

21. Metal anodes according to claim 18, in which the electroconductive and electrocatalytic surface contains at least one of the metals belonging to the group consisting of platinum, palladium, iridium, ruthenium, osmium, rhodium, iron (magnetite), nickel, chromium, copper, lead, manganese, as metal or as oxide, nitride, carbide or sulfide of the metal.

22. Metal anodes according to claim 18, in which the rods have circular section with diameter comprised between 2 and 16 mm.

* * * * *